US008061310B2

(12) United States Patent
Watanabe

(10) Patent No.: US 8,061,310 B2
(45) Date of Patent: Nov. 22, 2011

(54) VALVE TIMING CONTROL APPARATUS FOR INTERNAL COMBUSTION ENGINE

(75) Inventor: Masahiko Watanabe, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 448 days.

(21) Appl. No.: 12/398,459

(22) Filed: Mar. 5, 2009

(65) Prior Publication Data

US 2009/0235883 A1 Sep. 24, 2009

(30) Foreign Application Priority Data

Mar. 19, 2008 (JP) ..... 2008-070514

(51) Int. Cl.
*F01L 1/34* (2006.01)

(52) U.S. Cl. ..... 123/90.15; 123/90.17; 123/90.11; 251/129.01; 464/160

(58) Field of Classification Search ..... 123/90.11, 123/90.15, 90.16, 90.17, 90.18; 251/129.01; 464/1, 2, 160; 701/105, 112
See application file for complete search history.

(56) References Cited

U.S. PATENT DOCUMENTS 7,377,242 B2 * 5/2008 Uehama et al. ..... 123/90.17

FOREIGN PATENT DOCUMENTS

JP 2004-156508 A 6/2004

* cited by examiner

*Primary Examiner* — Ching Chang
(74) *Attorney, Agent, or Firm* — Foley & Lardner LLP

(57) ABSTRACT

A valve timing control apparatus for an internal combustion engine, including a drive rotary member that is rotated by the crankshaft, a driven rotary member that transmits rotational force input from the drive rotary member, to the camshaft, and an electromagnetic mechanism that acts to vary a relative rotational phase between the drive rotary member and the driven rotary member. After an ignition switch is turned off and the engine is stopped, the electromagnetic mechanism acts to produce detent torque and hold the relative rotational phase between the drive rotary member and the driven rotary member in a predetermined phase position by the detent torque.

21 Claims, 8 Drawing Sheets

VALVE TIMING CONTROL APPARATUS FOR INTERNAL COMBUSTION ENGINE

BACKGROUND OF THE INVENTION

The present invention relates to a valve timing control apparatus for an internal combustion engine, which variably controls opening and closing timings of an intake valve and/or an exhaust valve of the engine, for instance, by using a hysteresis brake.

Japanese Patent Application First Publication No. 2004-156508 discloses a valve timing control apparatus for an internal combustion engine including a timing sprocket to which a rotational force is input from an engine crankshaft, a camshaft supported so as to be rotatable with respect to the timing sprocket within a predetermined angular range, a sleeve connected to the camshaft, and a rotational phase adjusting mechanism for adjusting a relative rotational phase between the timing sprocket and the camshaft which is disposed between the timing sprocket and the sleeve.

The rotational phase control mechanism includes a radial guide window formed in the timing sprocket, a spiral guide (a spiral groove) formed in a disk plate, a link member having one end portion rotatably disposed on the sleeve and the other end portion radially moveably disposed in the radial guide, an engagement portion disposed on the other end portion of the link member and engaged at a distal end thereof with the spiral guide, and a hysteresis brake that applies a braking force to the disk plate depending on the engine operating condition.

An electromagnetic braking force is applied to the disk plate through a hysteresis material by energizing an electromagnetic coil of the hysteresis brake. Owing to the electromagnetic braking force, the engagement portion is radially moved along the radial guide window and slided along the spiral guide to thereby cause relative rotation of the timing sprocket and the sleeve (the camshaft) within a predetermined range of angle and variably control opening and closing timings of the intake valve in accordance with the engine operating condition.

SUMMARY OF THE INVENTION

Generally, in the valve timing control apparatus of the above-described conventional art, immediately after the engine is stopped by turning off an ignition switch, alternate torque between positive torque and negative torque is produced in the camshaft due to reaction force of a valve spring, so that the relative rotational phase between the timing sprocket and the camshaft might be changed to be offset from the rotational phase provided when the engine is stopped, that is, offset from the rotational phase suitable for the engine start-up. As a result, it will become difficult to restart the engine.

It is an object of the present invention to solve the above-described technical problem in the conventional art and provide a technique capable of holding a rotational phase between a drive rotary member and a driven rotary member in a rotational phase therebetween suitable for the engine start-up by detent torque of an electromagnetic mechanism when the engine is in the stopped state, and thereby serving for performing good restart of the engine.

In one aspect of the present invention, there is provided a valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member, to the camshaft; and an electromagnetic mechanism that acts to vary a relative rotational phase between the drive rotary member and the driven rotary member, wherein after an ignition switch is turned off and the engine is stopped, the electromagnetic mechanism acts to produce detent torque and hold the relative rotational phase between the drive rotary member and the driven rotary member in a predetermined phase position by the detent torque.

In a further aspect of the present invention, there is provided a valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member to the camshaft;

an intermediate rotary member that rotates relative to the drive rotary member to vary a relative rotational phase between the drive rotary member and the driven rotary member; and a hysteresis brake including an electromagnetic coil, a stator core and a hysteresis member rotatable in synchronization with the intermediate rotary member;

wherein after an ignition switch is turned off and rotation of the crankshaft is stopped, a battery voltage is applied to the electromagnetic coil until magnetic flux is generated in the electromagnetic coil.

In a still further aspect of the present invention, there is provided a valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member, to the camshaft;

an intermediate rotary member disposed in a route of transmitting the rotational force from the drive rotary member to the driven rotary member, the intermediate rotary member being moveable relative to the drive rotary member to vary a relative rotational phase between the drive rotary member and the driven rotary member;

a relative rotational phase holding mechanism that, when electrically energized, holds the relative rotational phase between the drive rotary member and the driven rotary member in an arbitrary phase position; and an electromagnetic brake including an electromagnetic coil, a stator core and a semi-hard magnetic member moveable together with the intermediate rotary member when the intermediate rotary member moves, the electromagnetic brake allowing magnetic flux to pass through the semi-hard magnetic member upon applying a voltage to the electromagnetic coil, wherein in the process of turning off an ignition switch and stopping rotation of the drive rotary member, after the ignition switch is turned off, the relative rotational phase holding mechanism is energized to hold the relative rotational phase between the drive rotary member and the driven rotary member in the arbitrary phase position, and after the rotation of the drive rotary member is stopped, a predetermined voltage is applied to the electromagnetic coil of the electromagnetic brake for a predetermined time period, and after application of the predetermined voltage to the electromagnetic coil of the electromagnetic brake for the predetermined time period, energization of the relative rotational phase holding mechanism is interrupted.

Other objects and features of this invention will become understood from the following description with reference to the accompanying drawings.

DETAILED DESCRIPTION OF THE INVENTION

With reference to the accompanying drawings, embodiments of a valve timing control apparatus for an internal combustion engine according to the present invention are explained. In the respective embodiments, the valve timing control apparatus is applied to a valve operating device for an intake valve, but the valve timing control apparatus can also be applied to a valve operating device for an exhaust valve. In the following description, various directional terms, such as, front, rear, forward, rearward and the like are used for ease of understanding of arrangement of parts, but are not to be understood as limiting terms.

First Embodiment

Figure 1:
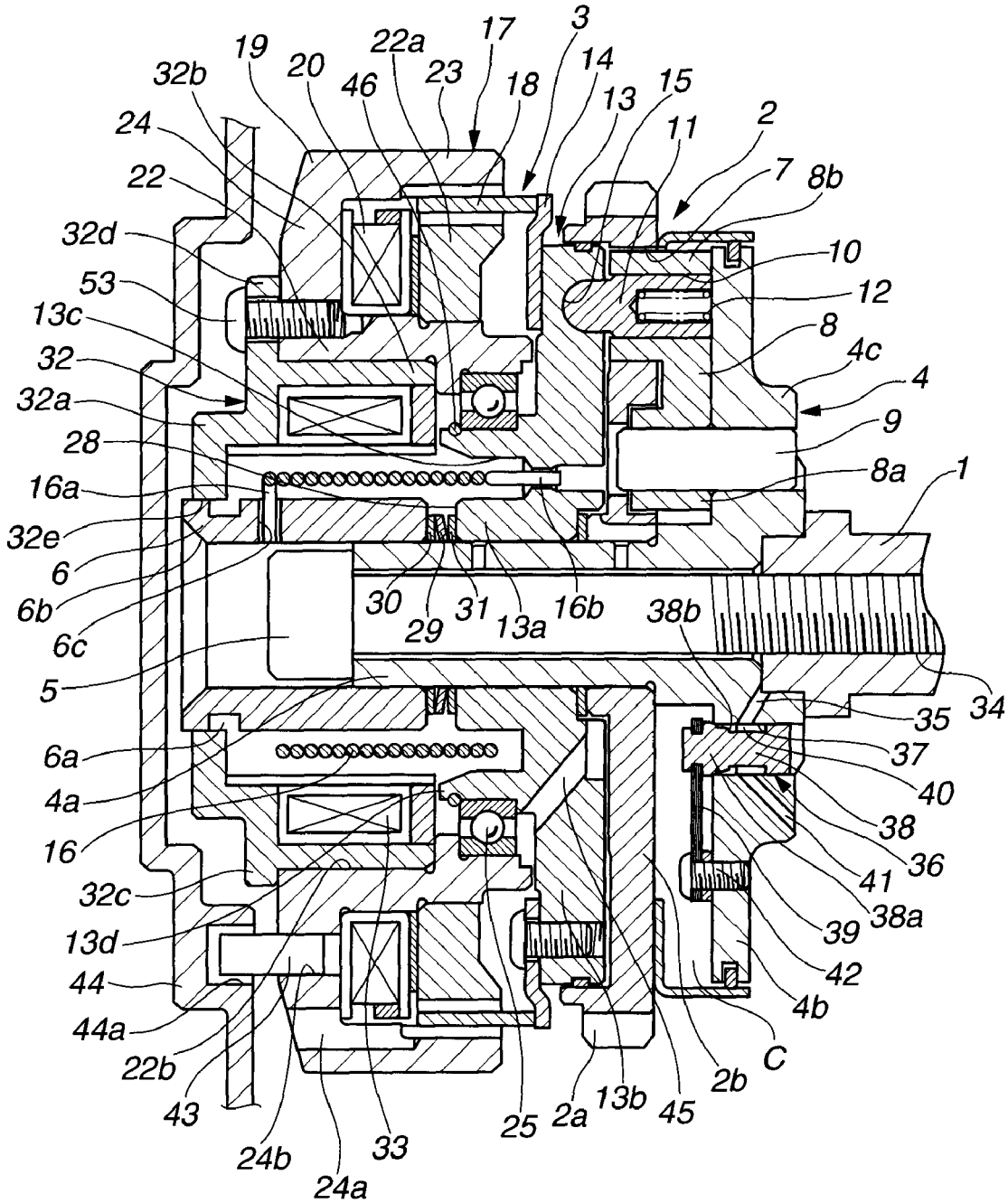
FIG. 1 is a vertical cross-section of a valve timing control apparatus according to a first embodiment of the present invention.
Figure 2:
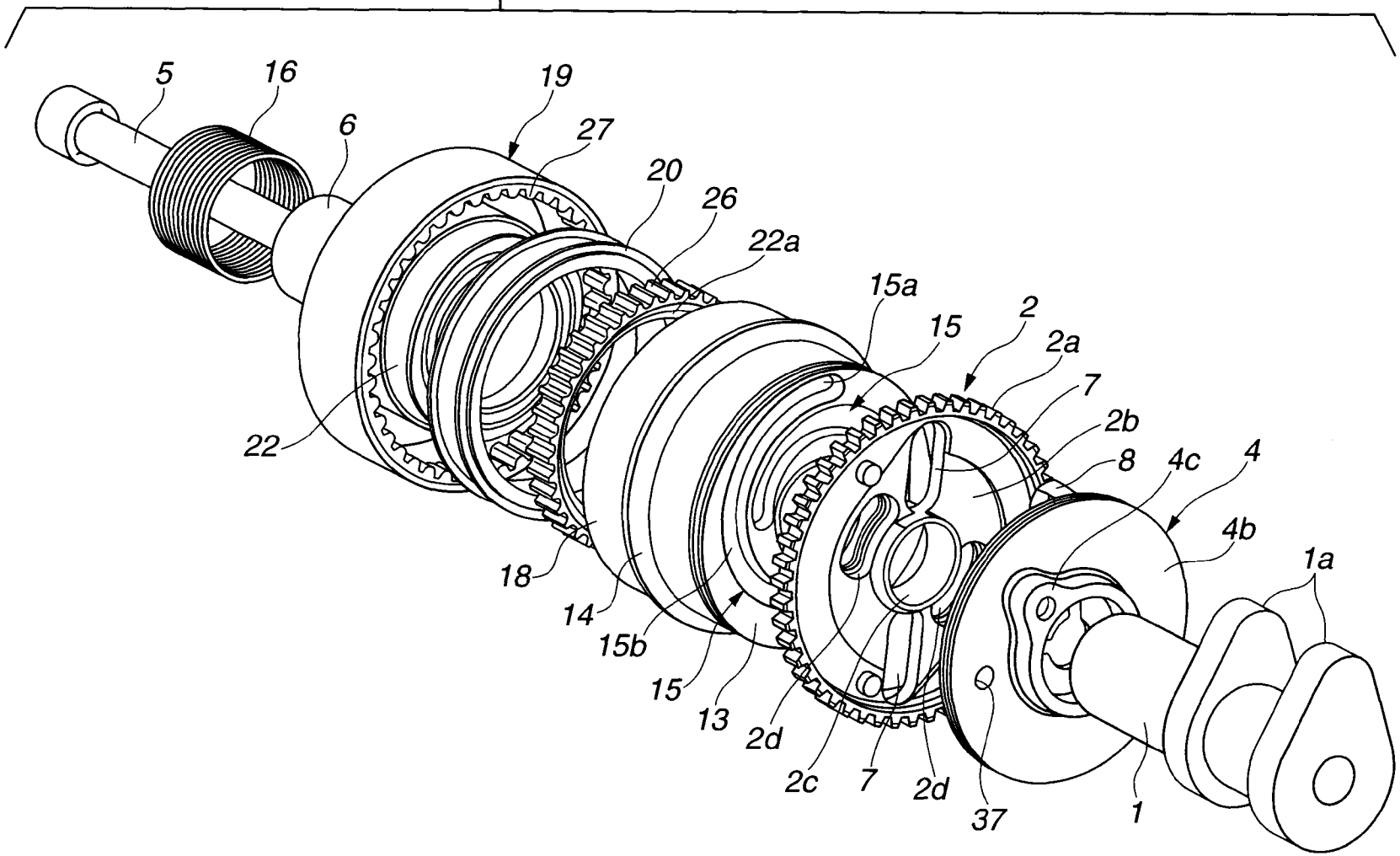
FIG. 2 is an exploded perspective view of the valve timing control apparatus of the first embodiment.

As shown in FIG. 1 and FIG. 2, the valve timing control apparatus (VTC) includes camshaft 1 that is rotatably supported on a cylinder head, not shown, of the internal combustion engine, timing sprocket 2 that is disposed on a side of a front end of camshaft 1 and rotatable relative to camshaft 1, and rotational phase adjusting mechanism 3 that is disposed on an inner circumferential side of timing sprocket 2 and adjusts the relative rotational phase between camshaft 1 and timing sprocket 2. Rotational phase adjusting mechanism 3 is an electromagnetic mechanism.

As shown in FIG. 2, camshaft 1 has two cams 1*a*, 1*a* on an outer circumferential surface thereof which are provided each cylinder and operative to open intake valves, not shown. As shown in FIG. 1, driven shaft member 4 is connected to a front end portion of camshaft 1 through cam bolt 5 that extends through driven shaft member 4 into the front end portion of camshaft 1 in an axial direction of driven shaft member 4 and camshaft 1. Driven shaft member 4 serves as a driven rotary member that transmits rotational force input from timing sprocket 2 to camshaft 1. Sleeve 6 is press-fit into a front end portion of driven shaft member 4 and secured thereto.

Driven shaft member 4 includes cylindrical shaft portion 4*a* having an inner through-hole through which cam bolt 5 extends, and increased-diameter flange portion 4*b* that is integrally formed with an outer periphery of a rear end portion of shaft portion 4*a* which is located on a side of camshaft 1.

Sleeve 6 is press-fit onto an outer circumferential surface of a tip end portion of shaft portion 4*a*. Sleeve 6 has annular groove 6*a* on an outer circumferential surface of a front end portion thereof, and tapered surface 6*b* on an inner circumferential side of the front end portion. Tapered surface 6*b* serves for facilitating insertion of cam bolt 5 into sleeve 6. Engaging hole 6*c* is formed near annular groove 6*a* on a rear side of annular groove 6*a*. Engaging hole 6*c* extends through the front end portion of sleeve 6 in a radial direction of sleeve 6 and is engaged with one end portion 16*a* of coil spring 16 as explained later.

Timing sprocket 2 serves as a drive rotary member that is rotated by an engine crankshaft. Specifically, timing sprocket 2 includes ring-shaped gear wheel 2*a* that is integrally formed with an outer circumferential portion of timing sprocket 2 and connected to the engine crankshaft through a timing chain, not shown. Timing sprocket 2 further includes generally disk-shaped plate member 2*b* that is disposed on an inner circumferential side of gear wheel 2*a*. As shown in FIG. 2, plate member 2*b* has insertion hole 2*c* on a central portion thereof. Insertion hole 2*c* receives shaft portion 4*a* of driven shaft member 4 such that timing sprocket 2 is rotatably supported on shaft portion 4*a*.

As shown in FIG. 2, plate member 2*b* of timing sprocket 2 includes two radial window holes 7, 7 which extend in a radial direction of plate member 2*b*. Radial window holes 7, 7 are disposed substantially along a diameter of timing sprocket 2 and extend through plate member 2*b*. Radial window holes 7, 7 serve as radial guides, each being defined by parallel side walls that are opposed to each other. Two guide holes 2*d*, 2*d* are formed between radial window holes 7, 7 and extend through plate member 2*b*. Each of guide holes 2*d*, 2*d* is formed into an arcuate shape and extends on an outer circumferential side of insertion hole 2*c* in the circumferential direction of timing sprocket 2. Guide holes 2*d*, 2*d* are engaged with end portions 8*a*, 8*a* of two link members 8, 8 and hold end portions 8*a*, 8*a* so as to be moveable in the circumferential direction of timing sprocket 2. Each of guide holes 2*d*, 2*d* has a length extending in an axial direction of timing sprocket 2 which is set within a range in which each of end portions 8*a*, 8*a* is moveable, that is, within a range in which the relative rotation between camshaft 1 and timing sprocket 2 is allowed.

Each of link members 8, 8 serving as a moveable actuating member is formed into a generally arcuate shape and has one cylindrically protrudent end portion 8*a* and opposite cylindrically protrudent end portion 8*b* which extend toward plate member 2*b* of timing sprocket 2, respectively. A pin retaining hole for pin 9 that connects each of link members 8, 8 with driven shaft member 4 is formed in one end portion 8*a* and extends through one end portion 8*a*.

Driven shaft member 4 has two projections 4*c*, 4*c* on a side of camshaft 1. Projections 4*c*, 4*c* are disposed on an inner circumferential side of flange portion 4*b* and integrally formed with flange portion 4*b*. Pin retaining holes are formed in projections 4*c*, 4*c* and extend through projections 4*c*, 4*c* and flange portion 4*b*. Each of pins 9, 9 has one end portion that is press-fit into the pin retaining holes in projections 4*c*, 4*c* of driven shaft member 4, and the other end portion that is rotatably engaged in the pin retaining hole provided at one end portion 8*a* of each of link members 8, 8.

Opposite end portion 8*b* of each of link members 8, 8 is engaged in each of radial window holes 7, 7 of timing sprocket 2. Opposite end portion 8*b* is formed with pin receiving hole 10 that extends through opposite end portion 8*b* in the axial direction of timing sprocket 2 and is opened to a front surface of link member 8. Engaging pin 11 and coil spring 12 that biases engaging pin 11 toward a front side of the VTC are accommodated in pin receiving hole 10. Engaging pin 11 has a spherical end portion that is engaged with spiral-grooved portion 15 of spiral disk 13 through radial window holes 7, 7 of timing sprocket 2. Engaging pin 11 is urged into spiral-grooved portion 15 by coil spring 12.

Link members 8, 8 are coupled to timing sprocket 2 through the engagement between end portions 8*b*, 8*b* and radial window holes 7, 7 of timing sprocket 2 and coupled to driven shaft member 4 through pins 9, 9 that connect end portions 8*a*, 8*a* with projections 4*c*, 4*c* of driven shaft member 4. When end portions 8*b*, 8*b* are displaced along radial window holes 7, 7 by an external force that is applied to end portions 8*b*, 8*b*, end portions 8*a*, 8*a* are displaced along guide holes 2*d*, 2*d* of timing sprocket 2 so that relative rotation of timing sprocket 2 and driven shaft member 4 is caused in a direction and at a rotational angle in accordance with the displacement of end portions 8*b*, 8*b*.

Spiral disk 13 serving as an intermediate rotary member is rotatably supported on an outer circumferential surface of shaft portion 4*a* of driven shaft member 4 on a front side of plate member 2*b* of timing sprocket 2 in an opposed relation to plate member 2*b*. Spiral disk 13 includes inner circumferential portion 13*a* slidably supported on the outer circumferential surface of shaft portion 4*a*, and disk portion 13*b* disposed on an outer circumferential side of inner circumferential portion 13*a*. Inner circumferential portion 13*a* has a generally cylindrical shape and a dual-wall structure including a radial-inner cylindrical wall and a radial-outer cylindrical wall which are separated from each other by annular groove 13*c* therebetween.

Spiral-grooved portion 15 is formed on a rear surface of disk portion 13*b* which is located on the side of camshaft 1. Spiral-grooved portion 15 includes a concave surface defining two spiral grooves that serve as a guide and have a semi-circular cross-section. Spiral-grooved portion 15 is engaged with tip ends of engaging pins 11 and guides the tip ends of engaging pins 11 so as to be slidably moved in and along the spiral grooves.

The spiral grooves of spiral-grooved portion 15 are separated from each other and formed to be gradually reduced in spiral radius along a circumferential direction of spiral disk 13, that is, along a rotational direction of timing sprocket 2. Each of the spiral grooves includes distal end portion 15*a* located on an outer-most circumferential side of the spiral groove, and general portion 15*b* that is continuously connected with distal end portion 15*a* and located on an inner circumferential side of distal end portion 15*a*. Distal end portion 15*a* is radially inwardly bent or deflected at a predetermined angle with respect to an outer-most end of general portion 15*b*. Distal end portion 15*a* has a bent end portion that extends from a substantially middle position of distal end portion 15*a* toward a tip end along a longitudinal direction of distal end portion 15*a* and is further radially inwardly bent with an extremely small angle relative to the longitudinal direction.

Specifically, general portion 15*b* has a constant rate of change in spiral (angular phase), but distal end portion 15*a* has a rate of change in spiral which is smaller than that of general portion 15*b*, on a side of a tip end of distal end portion 15*a* which extends from the substantially middle position of distal end portion 15*a*. Distal end portion 15*a* extends substantially linearly along a direction of a tangent to spiral disk 13 and has a relatively large length. A tip end part (namely, the bent end portion) of distal end portion 15*a* is radially inwardly bent in the substantially middle position of distal end portion 15*a* at the extremely small angle.

When spiral disk 13 is rotated in a retard direction with respect to timing sprocket 2 with engagement of engaging pins 11 with spiral-grooved portion 15, end portions 8*b* of link members 8 are guided by radial guide windows 7 in response to movement of engaging pins 11 along the spiral shape of spiral-grooved portion 15 and moved to a radial inside of spiral disk 13 (that is, an advance side). Conversely, when spiral disk 13 is rotated in an advance direction with respect to timing sprocket 2 with engagement of engaging pins 11 with spiral-grooved portion 15, end portions 8*b* of link members 8 are guided by radial guide windows 7 in response to movement of engaging pins 11 along the spiral shape of spiral-grooved portion 15 and moved to a radial outside of spiral disk 13. When engaging pins 11 are placed in the deflection portion of spiral-grooved portion 15, a relative rotational phase between timing sprocket 2 and camshaft 1 is controlled to a retard side.

When spiral disk 13 is further rotated in the advance direction and engaging pins 11 are placed in the tip end part of distal end portion 15*a* of spiral-grooved portion 15, the relative rotational phase between timing sprocket 2 and camshaft 1 is controlled to a phase that is slightly advanced with respect to the most-retarded phase and suitable for the engine start-up.

When a force that rotationally operates spiral disk 13 relative to camshaft 1 is input to spiral disk 13, end portions 8*b* of link members 8 is displaced by the force within radial guide windows 7 of timing sprocket 2 in the radial direction of timing sprocket 2 through the engagement between spiral-grooved portion 15 and the tip ends of engaging pins 11. At this time, a relative rotational force between timing sprocket 2 and driven shaft member 4 is transmitted through link members 8.

As shown in FIG. 1 and FIG. 2, a mechanism for applying the rotationally actuating force to spiral disk 13 includes torsion spring 16 that biases spiral disk 13, hysteresis brake 17 that serves as an electromagnetic brake, and an electronic controller (ECU), not shown, that serves as a phase controller. Torsion spring 16 biases spiral disk 13 in a direction reverse to the rotational direction of timing sprocket 2, namely, toward the retard side, through sleeve 6. Hysteresis brake 17 acts to bias spiral disk 13 in the rotational direction of timing sprocket 2, namely, toward the advance side. The ECU controls the braking force of hysteresis brake 17 in accordance with the engine operating condition. This mechanism acts to rotate spiral disk 13 relative to timing sprocket 2 or hold the relative rotational position between spiral disk 13 and timing sprocket 2.

Torsion spring 16 is disposed on an outer circumferential side of sleeve 6 and has one end portion 16*a* that is inserted into and engaged with radial engaging hole 6*c* of sleeve 6 which is formed in sleeve 6 in a radial direction of sleeve 6. The other end portion 16*b* of torsion spring 16 is inserted into and engaged with an axial engaging hole of spiral disk 13 which is formed in inner circumferential portion 13*a* of spiral disk 13 in an axial direction of spiral disk 13. Torsion spring 16 acts to rotationally bias spiral disk in a direction of a rotational phase for the engine start-up after the engine is stopped.

Hysteresis brake 17 includes annular plate 14 that is fixed to a front end surface of disk portion 13*b* of spiral disk 13 on an outer circumferential side of disk portion 13*b* through a screw, hysteresis ring 18 that is fixed to a front end surface of annular plate 14, annular first coil yoke 19 that is disposed on a front side of hysteresis ring 18 and serves as a stator core, and first electromagnetic coil 20 that is accommodated within first coil yoke 19 and induces magnetic force to first coil yoke 19.

Annular plate 14 is made of a non-magnetic material, in this embodiment, an austenitic stainless material, and has a predetermined radial width. Annular plate 14 is welded to the front end surface of disk portion 13*b* on the outer circumferential side of disk portion 13*b*. Annular plate 14 has an outer diameter larger than an outer diameter of spiral disk 13.

As shown in FIG. 1, hysteresis ring 18 is formed in a small cylindrical shape having a radial width fully smaller than that of annular plate 14. Hysteresis ring 18 is welded to an outer circumferential side of the front end surface of annular plate 14 and thereby is rotatable in synchronization with spiral disk 13. Hysteresis ring 18 is made of a hysteresis material as a semi-hard magnetic material which has such a magnetic hysteresis characteristic that magnetic flux is varied with phase delay with respect to variation in external magnetic field.

Hysteresis ring 18 (a hysteresis member) acts to generate detent torque as static torque when energization of first electromagnetic coil 20 is stopped, as explained later. Further, hysteresis ring 18 acts to release the detent torque when energization of first electromagnetic coil 20 is started to rotate hysteresis ring 18.

First coil yoke 19 has a generally U-shaped cross-section in an axial direction thereof and an annular groove on a side of a rear end thereof in which hysteresis ring 18 is disposed so as to be rotatable relative to first coil yoke 19. First coil yoke 19 includes inner stator 22 disposed on an inner circumferential side of first coil yoke 19, outer stator 23 disposed on an outer circumferential side of first coil yoke 19, and annular yoke 24 through which a front end portion of inner stator 22 and a front end portion of outer stator 23 are integrally connected with each other. First coil yoke 19 as a whole is formed into a generally cylindrical shape in which first electromagnetic coil 20 is covered by inner stator 22, outer stator 23 and annular yoke 24.

Inner stator 22 includes annular stator portion 22*a* and ball bearing 25 that supports spiral disk 13 so as to be rotatable on inner stator 22. Annular stator portion 22*a* is fixed to an outer circumferential side of inner stator 22 by a suitable method such as press-fitting. Ball bearing 25 is disposed between an inner circumferential surface of inner stator 22 and an outer circumferential surface of inner circumferential portion 13*a* of spiral disk 13.

C-ring 46 is fixedly fitted on the outer circumferential surface of a tip end portion of the radial-outer cylindrical wall of inner circumferential portion 13*a* of spiral disk 13 and limits displacement of ball bearing 25 in an axially outward direction of ball bearing 25, that is, in a forward direction of the VTC. Spiral disk 13 and hysteresis brake 17 are connected with each other through ball bearing 25 and displaceable together in the axial direction thereof.

Inner stator 22 (annular stator portion 22*a*) has a plurality of inner pole teeth 26 serving as S-pole, on an outer circumferential surface thereof. Inner pole teeth 26 are protrudent in a radial direction of inner stator 22 and equidistantly spaced from each other in a circumferential direction of inner stator 22. Outer stator 23 has a plurality of outer pole teeth 27 serving as N-pole, on an inner circumferential surface thereof. Outer pole teeth 27 are protrudent in a radial direction of outer stator 23 and equidistantly spaced from each other in a circumferential direction of outer stator 23. There is provided a predetermined radial clearance between inner pole teeth 26 and outer pole teeth 27. Each of inner pole teeth 26 and each of outer pole teeth 27 are alternately arranged with each other in the circumferential direction of inner stator 22 and outer stator 23. That is, inner pole teeth 26 and outer pole teeth 27 are arranged in an offset relation in the circumferential direction of inner stator 22 and outer stator 23.

Upon energization of first electromagnetic coil 20, there is generated the magnetic field between a top surface of each of inner pole teeth 26 and a top surface of the adjacent one of outer pole teeth 27 in the circumferential direction of inner stator 22 and outer stator 23. The magnetic field passes through hysteresis ring 18 with an inclination relative to the circumferential direction of inner stator 22 and outer stator 23.

The top surface of each of inner pole teeth 26 is opposed to an inner circumferential surface of hysteresis ring 18 in a radial direction of hysteresis ring 18 in a non-contact state with an air gap therebetween. The top surface of each of outer pole teeth 27 is opposed to an outer circumferential surface of hysteresis ring 18 in the radial direction of hysteresis ring 18 in a non-contact state with an air gap therebetween. The air gaps are set to a slight clearance so as to ensure a large magnetic force.

Annular yoke 24 has harness insertion hole 24*a* and pin insertion hole 24*b* in predetermined positions in a circumferential direction of annular yoke 24. A harness, not shown, of first electromagnetic coil 20 is inserted into harness insertion hole 24*a* and connected to the ECU. Pin insertion hole 24*b* extends in an axial direction of annular yoke 24, into which one end portion of pin 43 is press-fit as explained later.

When first electromagnetic coil 20 is energized through the harness by the ECU, the magnetic field is generated via first coil yoke 19 so that the magnetic force causes brake torque in hysteresis ring 18. Specifically, when hysteresis ring 18 is rotatively moved in the magnetic field between each of inner pole teeth 26 and the adjacent one of outer pole teeth 27 by energizing first electromagnetic coil 20, a direction of magnetic flux within hysteresis ring 18 and a direction of the magnetic field between each of inner pole teeth 26 and the adjacent one of outer pole teeth 27 are deflected from each other to thereby cause the braking force of hysteresis brake 17. The braking force has a value that varies substantially in proportion to an intensity of the magnetic field, that is, an amount of exciting current in first electromagnetic coil 20, regardless of the rotational speed of hysteresis ring 18 (i.e., the relative rotational speed between the inner and outer circumferential surfaces of hysteresis ring 18 and the outer circumferential surface of inner stator 22 and the inner circumferential surface of outer stator 23. First electromagnetic coil 20 can be supplied with current from a battery power source by the ECU in a predetermined time period immediately after the engine is stopped.

The ECU receives signals output from various sensors including a crank angle sensor for detecting engine rotational speed, an airflow meter for detecting load on the basis of intake air quantity, a throttle opening sensor for detecting opening degree of a throttle valve, and an engine coolant temperature sensor. The ECU determines a present operating condition of the engine on the basis of the signals. The ECU further outputs control current to first electromagnetic coil 20 on the basis of an actual relative rotational position between timing sprocket 2 and camshaft 1 and a preset target relative rotational position therebetween.

Phase adjusting mechanism 3 is constituted of radial window holes 7, link members 8, engaging pins 11, projections 4*c*, 4*c* of driven shaft member 4, spiral disk 13, spiral-grooved portion 15 and hysteresis brake 17. First coil yoke 19 is prevented from rotating by pin 43 that has one end portion press-fit into insertion hole 24*b* in annular yoke 24 and an opposite end portion received in engaging hole 44*a* in VTC cover 44. First coil yoke 19 is permitted to move in an axial direction thereof.

A relative rotational phase holding mechanism is provided between sleeve 6 and spiral disk 13, which acts to bias spiral disk 13 in a direction of a rotation axis of spiral disk 13 (namely, in a rightward direction in FIG. 1) and hold timing sprocket 2 and camshaft 1 (driven shaft member 4) in a predetermined relative rotational position, that is, hold a relative rotational phase between timing sprocket 2 and camshaft 1 in a predetermined phase position. Further, a holding canceling mechanism is provided on an inner circumferential side of first coil yoke 19, which acts to cancel the biasing and holding by the relative rotational phase holding mechanism and adjust a sliding resistance that is caused between spiral-grooved portion 15 of spiral disk 13 as one component of the relative rotational phase holding mechanism and engaging pins 11 as the other component thereof by the biasing force.

The relative rotational phase holding mechanism is basically constituted of annular space 28 that is formed between a rear end face of sleeve 6 and a front end face of inner circumferential portion 13*a* of spiral disk 13, and disc spring 29 as a biasing member which is disposed within annular space 28 and made of metal.

Disc spring 29 is disposed between annular spring retainers 30, 31 in order to ensure good slidability when disc spring 29 is flexibly deformed. Disc spring 29 biases spiral disk 13 as a whole in the rightward direction in FIG. 1 (i.e., toward timing sprocket 2) by the spring force such that the groove-defining concave surface of spiral-grooved portion 15 is pressed onto the tip end surface of each of engaging pins 11 to be in elastic contact therewith. There occurs frictional resistance force between the groove-defining concave surface of spiral-grooved portion 15 and the tip end surface of each of engaging pins 11. Owing to the frictional resistance force, disc spring 29 limits the rotation of spiral disk 13 and holds a rotational position of spiral disk 13 relative to driven shaft member 4 and thereby holds the relative rotational position between timing sprocket 2 and camshaft 1. The frictional resistance force can be variably set on the basis of spring set load of disc spring 29. In this embodiment, the frictional resistance force is set to a relatively small one. Disc spring 29 can be replaced with a wave spring washer.

The holding canceling mechanism is constituted of an electromagnet that includes second coil yoke 32 and second electromagnetic coil 33 accommodated in second coil yoke 32. Second coil yoke 32 is disposed within a dead space on an inner circumferential side of inner stator 22 in a position forward of inner circumferential portion 13*a* of spiral disk 13.

Second coil yoke 32 is formed into a generally U-shape in section and has a generally flange-shaped front stator 32*a* on a side of a front end of second coil yoke 32, and a generally cylindrical rear stator 32*b* connected to an annular rear surface of front stator 32*a*. Rear stator 32*b* is placed in a substantially radial-middle position on the annular rear surface of front stator 32*a* and integrally formed with front stator 32*a*. Second coil yoke 32 is engaged with crank-shaped step 22*b* that is formed on the inner circumferential side of inner stator 22, and is fixedly press-fit to crank-shaped step 22*b* in a predetermined position in both the radial direction and the axial direction.

Front stator 32*a* has a generally crank-shaped bent section and includes outer circumferential portion 32*c* that is in contact with a front end surface of annular yoke 24 to thereby restrict a maximum amount of press-fitting of the whole second coil yoke 32 relative to inner stator 22. A plurality of projections 32*d* extend from an outer circumferential periphery of outer circumferential portion 32*c* in a radial direction of front stator 32*a* and are integrally formed therewith. Each of projections 32*d* is fixed to the inner circumferential side of inner stator 22 by means of bolt 53. Front stator 32*a* further includes an inner circumferential portion having inner circumferential surface 32*e* that is arranged offset from annular groove 6*a* of sleeve 6 in an axial direction of front stator 32*a* such that a rear-end portion of inner circumferential surface 32*e* is opposed to annular groove 6*a* and a front portion of inner circumferential surface 32*e* is in contact with the outer circumferential surface of sleeve 6. On the other hand, rear stator 32*b* has an annular rear-end surface that is disposed in proximity to front-end surface 13*d* of the radial-outer cylindrical wall of inner circumferential portion 13*a* of spiral disk 13 with a slight clearance.

Second electromagnetic coil 33 is energized or de-energized through a harness, not shown, in response to ON signal or OFF signal output from the ECU that controls energization or de-energization of first electromagnetic coil 20. The ECU further controls an amount of current to be supplied when second electromagnetic coil 33 is energized.

Specifically, when the amount of current which is supplied to second electromagnetic coil 33 is increased to a maximum in response to the ON signal from the ECU, the magnetic field is generated so that the magnetic force thus generated allows hysteresis brake 17 and spiral disk 13 to be displaced relative to sleeve 6 toward VTC cover 44 (i.e., in the leftward direction in FIG. 1) against the biasing force (i.e., the spring force) of disc spring 29. Spiral-grooved portion 15 of spiral disk 13 comes into disengagement from engagement pins 11 so that the groove-defining concave surface of spiral-grooved portion 15 is separated from the tip end surface of each of engaging pins 11. The amount of current which is supplied to second electromagnetic coil 33 is controlled to increase or decrease in response to output of the ON signal. Therefore, it is possible to control the frictional resistant force that is caused by the pressing force of spiral disk 13 owing to the biasing force of disc spring 29. That is, the frictional resistant force that is caused between the concave surface of spiral-grooved portion 15 and the tip end surface of each of engaging pins 11 can be adjusted.

Further, in this embodiment, there is provided a cooling device (an oil supply device) that supplies a cooling oil to rotational phase adjusting mechanism 3.

As shown in FIG. 1, the cooling device includes annular passage 34 that is formed between camshaft 1 and cam bolt 5, oil supply passage 35 that is formed in driven shaft member 4, and flow control valve 36 that controls a flow of the cooling oil passing through oil supply passage 35 in accordance with a temperature of the cooling oil.

Annular passage 34 is communicated with a main oil gallery that supplies lubricating oil discharged from an oil pump, not shown, to sliding parts of the engine, through which a part of the lubricating oil discharged from the oil pump is introduced into annular passage 34.

Oil supply passage 35 extends from the inner circumferential side of shaft portion 4*a* of driven shaft member 4 into flange portion 4*b* in an inclined state relative to the axial direction of driven shaft member 4. Oil supply passage 35 has an upstream end that is communicated with annular passage 34, and a downstream end that is communicated with an inside of rotational phase adjusting mechanism 3 through valve bore 37 of flow control valve 36.

Flow control valve 36 includes valve bore 37 that extends through flange portion 4*b* of driven shaft member 4 in the axial direction of driven shaft member 4 so as to be communicated with the downstream end of oil supply passage 35. Flow control valve 36 further includes valve body 38 that is slidably disposed within valve bore 37 so as to be moveable in an axial direction of valve bore 37, and temperature detecting member 39 that is flexibly deformable to allow the sliding movement of valve body 38 within valve bore 37 depending on ambient temperature including the cooling oil temperature.

Valve bore 37 is disposed on an inner circumferential side of flange portion 4*b* and formed into a cylindrical shape having a generally uniform inner diameter. Valve bore 37 has one open end that is exposed to space C between flange portion 4*b* and plate member 2*b* of timing sprocket 2, and a substantially middle portion in the axial direction of driven shaft member 4 to which the downstream end of oil supply passage 35 is opened.

Valve body 38 is formed into a stepped and generally cylindrical shape. Valve body 38 includes a small-diameter shaft portion that is located in a substantially middle position in an axial direction of valve body 38, a cylindrical land portion that is disposed on a rear side of the small-diameter shaft portion, generally cylindrical valve portion 38*a* that is disposed on a front side of the small-diameter shaft portion, and an engaging portion that is integrally formed with a front end portion of valve portion 38*a*. The land portion is integrally formed with the small-diameter shaft portion and has an outer circumferential surface that comes into sliding contact with an inner circumferential surface of valve bore 37. Valve portion 38*a* is integrally formed with the small-diameter shaft portion and has an outer circumferential surface that comes into sliding contact with the inner circumferential surface of valve bore 37.

Oil introducing chamber 40 having an annular shape is defined between an outer circumferential surface of the small-diameter shaft portion of valve body 38 and the inner circumferential surface of valve bore 37. The downstream end of oil supply passage 35 is always exposed to oil introducing chamber 40. Discharge passage 41 is formed in flange portion 4*b* of driven shaft member 4 so as to be on an opposite side of oil supply passage 35 with respect to a central axis of valve bore 37. Discharge passage 41 discharges an excessive amount of the lubricating oil introduced into oil introducing chamber 40, from oil introducing chamber 40. Discharge passage 41 has a cross-section that is considerably smaller than a cross-section of oil supply passage 35 and set such that the oil temperature is transmitted to temperature detecting member 39 through flange portion 4*b* of driven shaft member 4 even in a low oil temperature condition.

The land portion of valve body 38 has a front end surface that is opposed to a rear end surface of valve portion 38*a* in the axial direction of valve body 38. The front end surface of the land portion and the rear end surface of valve portion 38*a* serve as pressure receiving surfaces to which a pressure of the lubricating oil introduced into oil introducing chamber 40 is applied, and are equal in area to each other when viewed in the axial direction of valve body 38. The land portion and valve portion 38*a* have an outer diameter that is slightly smaller than an inner diameter of valve bore 37 to thereby generate a slight clearance between the outer circumferential surface of the land portion and the inner circumferential surface of valve bore 37 and between the outer circumferential surface of valve portion 38*a* and the inner circumferential surface of valve bore 37 in order to ensure good slide characteristic relative to each other. The slight clearance is set such that an oil film is formed between the outer circumferential surface of the land portion and the inner circumferential surface of valve bore 37 and between the outer circumferential surface of valve portion 38*a* and the inner circumferential surface of valve bore 37.

Oil introducing chamber 40 has a sectional area that is larger than a sum of a sectional area of oil supply passage 35, a sectional area of discharge passage 41, and a sectional area of a pair of control passage grooves 38*b* as explained later.

Control passage grooves 38*b* are formed on the outer circumferential surface of valve portion 38*a* and diametrically opposed to each other. Each of control passage grooves 38*b* is stepwisely inclined from a side of the pressure receiving surface of valve portion 38*a* toward the outer circumferential surface of valve portion 38*a*. Control passage groove 38*b* is defined by a planar bottom surface that is formed on the side of the pressure receiving surface of valve portion 38*a*, a slant surface that extends from the bottom surface in a state inclined in a forward and radially outward direction of valve portion 38*a*, and a distal end surface that is formed on a side of a front end of the slant surface and slightly inclined toward the outer circumferential surface of valve portion 38*a*.

Temperature detecting member 39 is formed by a stacked body including four rectangular metal plates, for instance, a bimetal, which each have a small thickness and are stacked on one another. Temperature detecting member 39 has one end portion that has an arcuate outer periphery and a bolt insertion hole. The other end portion of temperature detecting member 39 has a rectangular shape and a bifurcated retainer portion. The bifurcated retainer portion is engaged with a generally U-shaped groove formed in the engaging portion of valve portion 38*a* so that the engaging portion of valve portion 38*a* is supported by opposed arms of the bifurcated retainer portion therebetween. The one end portion of temperature detecting member 39 is fixedly connected to flange portion 4*b* of driven shaft member 4 through a washer by means of bolt 42 that is inserted into the bolt insertion hole.

The lubricating oil supplied to space C between flange portion 4*b* and plate member 2*b* of timing sprocket 2 passes around end portions 8*a* of link member 8 and enters into a space between plate member 2*b* of timing sprocket 2 and disk portion 13*b* of spiral disk 13. The lubricating oil then is supplied to ball bearing 25 through oil hole 45 that is formed in disk portion 13*b*, and to hysteresis ring 18 and then the clearance between pole teeth 26 and pole teeth 27 through oil hole 45 that is formed in disk portion 13*b*.

A basic operation of the valve timing control apparatus is explained hereinafter. When the engine is stopped, energization of first electromagnetic coil 20 by the ECU is interrupted and the operation of the electromagnetic brake mechanism, i.e., hysteresis brake 17, is stopped. At this time, spiral disk 13 is urged by the spring force of torsion spring 16 to rotatively move to a maximum rotational position relative to timing sprocket 2 in the engine rotating direction. In the maximum rotational position, the spherical tip end portion of each of engaging pins 11 is in contact with the tip end edge of distal end portion 15*a* of spiral-grooved portion 15 to thereby provide a relative rotational phase between the crankshaft and camshaft 1, that is, the opening and closing timing of the engine valve, which is slightly advanced with respect to the most-retarded phase and suitable for start-up of the engine.

Figure 3A:
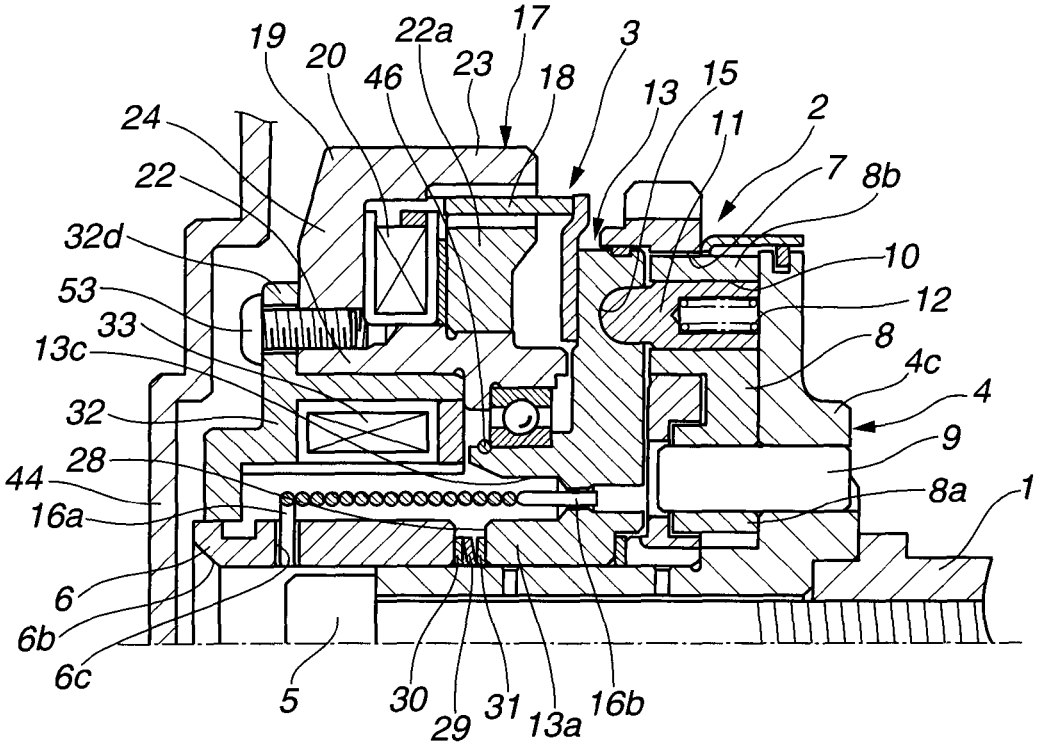
FIG. 3A is an explanatory diagram illustrating a holding state of the valve timing control apparatus of the first embodiment.

On the other hand, when the OFF signal is output from the ECU to second electromagnetic coil 33 simultaneously with the interruption of energization of first electromagnetic coil 20, hysteresis brake 17 and spiral disk 13 are urged by the spring force of disc spring 29 to move rearward (i.e., rightward in FIG. 3A) such that the circumferential surface of spiral-grooved portion 15 is elastically contacted with the tip end portion of each of engaging pins 11. Therefore, spiral disk 13 can be stably and certainly held in a predetermined slightly advanced rotational position in which the relative rotational phase between the crankshaft and camshaft 1 is slightly advanced. The control of the valve timing control apparatus upon the engine stop is explained in detail later.

Subsequently, an ignition switch is turned on and cranking of the engine is started. At this time, the ON signal is not output from the ECU and second electromagnetic coil 33 is still in the de-energized state. Therefore, spiral disk 13 is kept held in the predetermined slightly advanced position at the time when the engine is stopped. As a result, an optimal relative rotational phase between camshaft 1 and timing sprocket 2 is provided to thereby enhance starting performance of the engine.

Figure 3B:
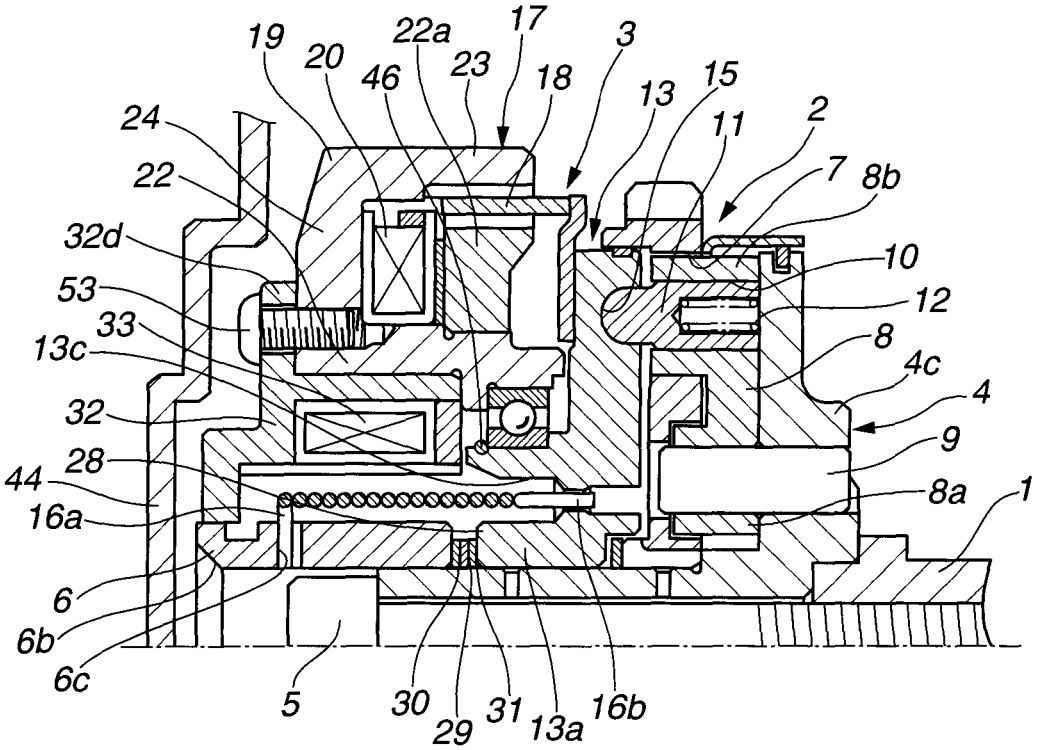
FIG. 3B is an explanatory diagram illustrating a release state of the valve timing control apparatus of the first embodiment.

After that, when the cranking is completed and a first idling is started, second electromagnetic coil 33 is energized so that spiral disk 13 is urged by the electromagnetic attraction force produced in second coil yoke 32 to slightly move forward (i.e., in the leftward direction in FIG. 3B) against the spring force of disc spring 29. The elastic contact between spiral-grooved portion 15 of spiral disk 13 and engaging pins 11 is released so that spiral disk 13 is permitted to move from the predetermined slightly advanced rotational position and freely rotate.

When transition to the operation in a low rotational speed region such as the subsequent idling is performed, first electromagnetic coil 20 is energized and excited to thereby produce a brake torque in hysteresis ring 18 and apply the braking force of hysteresis brake 17 against the spring force of torsion spring 16 to spiral disk 13.

Owing to the braking force, engaging pins 11 are displaced from distal end portion 15*a* of spiral-grooved portion 15 toward a side of the deflection portion of spiral-grooved portion 15. Then, spiral disk 13 is slightly rotated in a direction reverse to the rotational direction of timing sprocket 2. At this time, engaging pins 11 at end portions 8*b* of link members 8 is guided along spiral-grooved portion 15, and end portions 8*b* are moved along radial window holes 7 of timing sprocket 2 in the radially outward direction of timing sprocket 2. By the operation of link members 8 connecting timing sprocket 2 and driven shaft member 4, the relative rotational phase angle between timing sprocket 2 and driven shaft member 4 is varied to a most-retarded phase angle.

As a result, the relative rotational phase between the crankshaft and camshaft 1 can be varied to an optional one in accordance with the engine operating condition. For instance, the optional relative rotational phase includes a retarded phase and the most-retarded phase which are suitable for the low rotational speed of the engine. This serves for stabilizing the engine rotation and enhancing fuel economy during the idling operation.

Further, during the idling operation, second electromagnetic coil 33 is supplied with an amount of current which is suitably controlled by the ECU. Specifically, the amount of current to be supplied to second electromagnetic coil 33 is suitably adjusted in accordance with the engine condition, for instance, engine temperature, variation in phase caused by the VTC. Owing to the control of the amount of current to be supplied to second electromagnetic coil 33, spiral disk 13 is urged to slightly move rightward or leftward in FIG. 1 and FIGS. 3A and 3B. Therefore, there occurs variation in frictional resistance force that is caused between the concave surface of spiral-grooved portion 15 and engaging pins 11 at the time of change in the relative rotational phase angle between timing sprocket 2 and driven shaft member 4, so that the change in the relative rotational phase angle between timing sprocket 2 and driven shaft member 4 is slowly performed.

As a result, the relative rotational phase between the crankshaft and camshaft 1 can be slowly varied in accordance with change in the engine condition such as the engine temperature, thereby serving for enhancing the fuel economy and stabilizing the engine rotation.

Next, when the idling operation is shifted to a normal driving operation, for instance, to the operation in a high rotational speed region, the ECU outputs a command signal for varying the relative rotational phase angle between timing sprocket 2 and driven shaft member 4 to the most-advanced phase angle. First electromagnetic coil 20 is supplied with a larger amount of current, so that a large braking force of hysteresis brake 17 against the spring force of torsion spring 16 is applied to spiral disk 13 through hysteresis ring 18.

Owing to the large braking force of hysteresis brake 17, spiral disk 13 is further rotated in the direction reverse to the rotational direction of timing sprocket 2. At this time, engaging pins 11 at end portions 8*b* of link members 8 is guided along spiral-grooved portion 15, and end portions 8*b* are moved along radial window holes 7 of timing sprocket 2 in the radially inward direction of timing sprocket 2. By the operation of link members 8 connecting timing sprocket 2 and driven shaft member 4, the relative rotational phase angle between timing sprocket 2 and driven shaft member 4 is varied to a most-advanced phase angle.

As a result, the relative rotational phase between the crankshaft (timing sprocket 2) and camshaft 1 is changed to the most-advanced phase to thereby enhance high power output.

When the rotational position of spiral disk 13 is changed to the retarded position or the advanced position in accordance with change in the engine operating condition, second electromagnetic coil 33 is previously energized by the ECU and the holding force, namely, the spring force, of disc spring 29 which is applied to spiral disk 13 is released or cancelled to thereby permit free rotation of spiral disk 13. On the other hand, when the relative rotational phase between timing sprocket 2 and camshaft 1 is held in a desired phase position, the ECU outputs the OFF signal for de-energization of second electromagnetic coil 33 so that spiral disk 13 is held in the rotational position by disc spring 29.

In every condition of the relative rotational phase angle between timing sprocket 2 and camshaft 1, a stable phase angle holding performance can be obtained by holding the relative rotational phase angle. Further, a subsequent quick phase conversion performance can be obtained by releasing the holding force of disc spring 29 by energization of second electromagnetic coil 33. Both of these performances can be attained.

Further, the control of the amount of current to be supplied to second electromagnetic coil 33 can be optionally carried out even in a steady driving mode in accordance with the engine operating condition without being limited to the idling operation. It is possible to slowly control the relative rotational phase angle between timing sprocket 2 and camshaft 1 by the VTC by controlling the amount of current to be supplied to second electromagnetic coil 33 in the steady driving mode. Therefore, engine torque can be controlled without varying an accelerator opening (that is, fuel injection quantity), serving for enhancing fuel economy.

Figure 4:
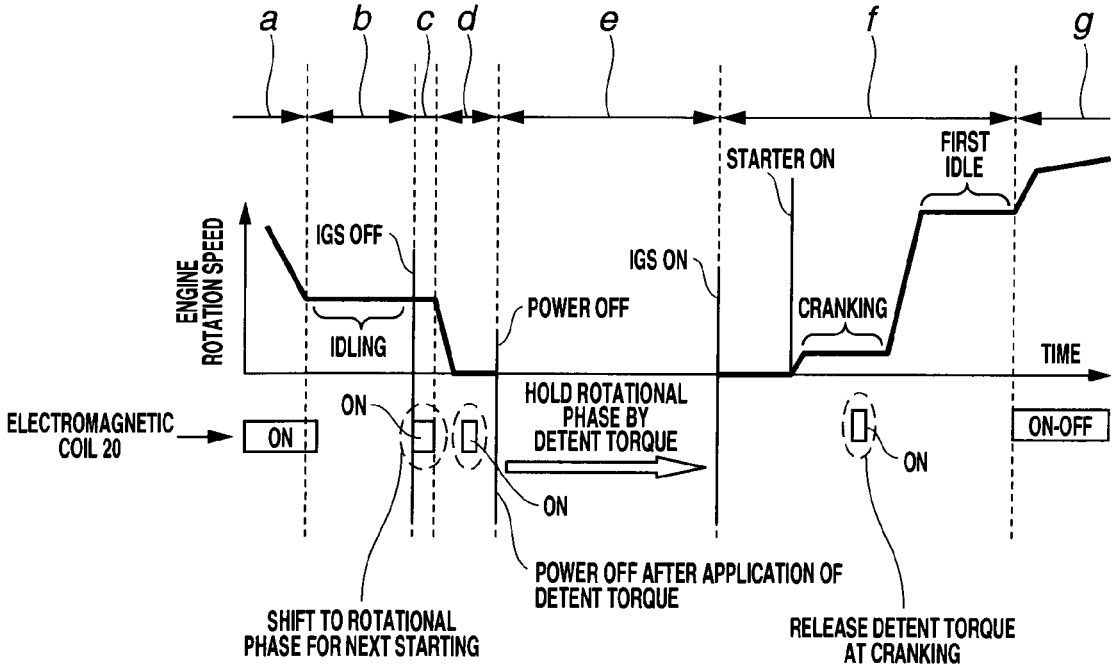
FIG. 4 is a time chart showing a control that is performed during a time period from engine stop to engine restart by the valve timing control apparatus of the first embodiment.

FIG. 4 is a time chart showing a control that is performed during a time period from engine stop to engine restart by the VTC of the first embodiment. By controlling energization and de-energization of first electromagnetic coil 20, an optimal startability of the engine can be ensured utilizing the property of the hysteresis material of hysteresis ring 18.

Specifically, in region "a", the engine is driven in the vehicle running state, and the control of the relative rotational phase between camshaft 1 and timing sprocket 2 is performed by hysteresis brake 17.

Next, in region "b", the vehicle is stopped and the engine is in the idling state. In this condition, the control of the relative rotational phase between camshaft 1 and timing sprocket 2 is not necessary. Therefore, energization of first electromagnetic coil 20 is interrupted and energization of second electromagnetic coil 33 is interrupted to thereby perform the spiral disk holding operation of disc spring 29.

Next, in region "c", the ignition switch (IGS) is turned off by a vehicle driver in order to stop the engine, but the engine rotation is not promptly stopped and the idling operation is continued. In this condition, second electromagnetic coil 33 is energized to thereby temporarily release spiral disk 13 from the holding state caused by disc spring 29. At the same time, first electromagnetic coil 20 is energized to thereby actuate hysteresis brake 17 to rotate spiral disk 13 so that the relative rotational phase between camshaft 1 and timing sprocket 2 is controlled to a desired phase position suitable for the engine restart, namely, an arbitrary phase position in which the engine is enabled to restart. After the relative rotational phase is controlled to the desired phase position, the energization of second electromagnetic coil 33 is interrupted to thereby hold spiral disk 13 in the rotational position by the holding force of disc spring 29.

Subsequently, in region "d", the engine rotation is stopped under the condition that the relative rotational phase between camshaft 1 and timing sprocket 2 is held in the desired phase position suitable for the engine restart by disc spring 29, and after the engine rotation is completely stopped, a constant voltage from a battery power source is temporarily applied to first electromagnetic coil 20 for a predetermined short time period to thereby excite first electromagnetic coil 20. That is, detent torque is produced in hysteresis ring 18 by energizing first electromagnetic coil 20 for the predetermined short time period. After that, when the battery power source is turned off, hysteresis ring 18 is magnetized under a fixed magnetic field to thereby maintain the relative rotational phase holding force by the detent torque.

Next, in region "e", the engine is in the completely stopped state. In this condition, the detent torque produced in hysteresis ring 18 successively acts to hold the relative rotational phase between camshaft 1 and timing sprocket 2 in the phase position suitable for the engine restart, that is, hold engaging pins 11 and radially inwardly bent distal end portion 15*a* of spiral-grooved portion 15 of spiral disk 13 in the mutually engaged state.

Next, in region "f", at the time when the IGS is turned on in order to perform the engine restart, second electromagnetic coil 33 is not energized to thereby maintain the holding state in which the relative rotational phase between camshaft 1 and timing sprocket 2 is held in the phase position suitable for the engine restart by disc spring 29 of the relative rotational phase holding mechanism. The rotational phase holding operation by disc spring 29 may be performed at any time during a time period from at least turn-on of the IGS until turn-on of a starter motor. Subsequently, the starter motor is turned on and cranking is started. During the cranking, first electromagnetic coil 20 is energized to release the detent torque, and immediately after that, energization of first electromagnetic coil 20 is interrupted.

The release of the detent torque can be performed at any time during a time period from immediately after the cranking is started until the control of the relative rotational phase between camshaft 1 and timing sprocket 2 is started. That is, hysteresis ring 18 has the property of releasing the detent torque and the rotational phase holding force when energization of first electromagnetic coil 20 is interrupted under a variable magnetic field.

Next, in region "g", the control of the relative rotational phase between camshaft 1 and timing sprocket 2 is started in accordance with the engine operating condition as described above. Immediately after the start of the control of the relative rotational phase, second electromagnetic coil 33 is energized to thereby release the holding operation of disc spring 29.

As explained above, in this embodiment, when the engine is stopped, the relative rotational phase between camshaft 1 and timing sprocket 2 can be held in the phase position suitable for the engine restart by the detent torque that is produced in hysteresis ring 18. Accordingly, the restart of the engine can be better performed.

Further, in this embodiment, when the engine is stopped, engaging pins 11 are urged by alternate torque to move to distal end portion 15*a* of spiral-grooved portion 15 which is bent in the radially inward direction of spiral disk 13, and thereby slightly advance the relative rotational phase between camshaft 1 and timing sprocket 2. Accordingly, it is possible to further enhance the effect of holding the relative rotational phase between camshaft 1 and timing sprocket 2 by the detent torque.

Further, as described above, during the idling operation, the amount of current to be supplied to second electromagnetic coil 33 is adjusted so as to control variation in frictional resistance force between the groove-defining concave surface of spiral-grooved portion 15 and engaging pins 11 and thereby change the operating speed of the VTC. Therefore, the VTC of this embodiment can serve for enhancing fuel economy.

Further, in this embodiment, the relative rotational phase holding mechanism employs disc spring 29. Therefore, as compared to the case of using a coil spring, it is not necessary to increase an axial length of the VTC of this embodiment, so that the axial length can be reduced. As a result, the VTC of this embodiment can be enhanced in installability relative to the engine.

Further, energization of second electromagnetic coil 33 is conducted only for a short time period when the holding force of disc spring 29 is to be cancelled and immediately after the control of the relative rotational phase between camshaft 1 and timing sprocket 2 is to be started. Therefore, reduction in power consumption for energization of second electromagnetic coil 33 can be fully attained.

Further, the relative rotational phase holding mechanism and the holding canceling mechanism are respectively simplified in construction. Owing to the simplified construction, the production work and the assembling work can be facilitated, and therefore, increase in the production cost can be suppressed.

Further, second coil yoke 32 and second electromagnetic coil 33 are arranged within a dead space on the inner circumferential side of first coil yoke 19. With this arrangement, the dead space can be effectively utilized and upsizing of the VTC as a whole can be suppressed.

Further, since spiral disk 13 is rotatably supported on an inner periphery of first coil yoke 19 through ball bearing 25, spiral disk 13 can be prevented from displacement in the radial direction thereof.

Further, in this embodiment, when the temperature of the oil introduced into oil introducing chamber 40 via oil supply passage 35 is extremely low, for instance, 10° C. or less at the time of engine start-up, temperature detecting member 39 is in substantially linear state without being deflected. Therefore, valve portion 38*a* of valve body 38 is in a closing state where valve portion 38*a* closes oil introducing chamber 40 to thereby block a flow of the oil introduced into oil introducing chamber 40 via oil supply passage 35. Accordingly, the oil introduced into oil introducing chamber 40 is prevented from flowing into space C between flange portion 4*b* and plate member 2*b* of timing sprocket 2, and is discharged to an upper side of the cylinder head through discharge passage 41. At this time, the pressure of the oil introduced into oil introducing chamber 40 is evenly shared by both the front end surface of the land portion and the rear end surface of valve portion 38*a* because discharge passage 41 has a cross-section that is smaller than a cross-section of oil supply passage 35. As a result, valve body 38 is balanced in the axial direction and prevented from undergoing a force that acts on valve body 38 so as to project from and retreat into valve bore 37.

When the oil temperature introduced into oil introducing chamber 40 becomes a predetermined temperature or more under this condition, the oil temperature is transmitted to temperature detecting member 39 through bolt 42 from flange portion 4*b* so that temperature detecting member 39 is held at the same temperature as the oil temperature. As a result, variation in temperature of start of actuation of flow control valve 36 can be suppressed.

When the oil temperature is increased to a predetermined temperature or more, the end portion of temperature detecting member 39 which is connected with the engaging portion of valve portion 38*a* through the bifurcated retainer portion is slightly deflected to move valve body 38 toward plate member 2*b* of timing sprocket 2 and slightly project valve body 38 from valve bore 37. At this time, a front side of the slant surface and the distal end surface which cooperate to define each of control passage grooves 38*b* are exposed to an inside of space C to thereby provide a fluid path with a small opening area in each of control passage grooves 38*b* and allow fluid communication between space C and valve bore 37 through the fluid path with a small opening area in each of control passage grooves 38*b*. A part of the oil within oil introducing chamber 40 is discharged from discharge passage 41 and other part is introduced into space C through control passage grooves 38*b*.

After that, when the oil temperature is further increased, valve body 38 is further projected from valve bore 37 along with the deformation of temperature detecting member 39 due to the oil temperature rise. The fluid path with a small opening area in each of control passage grooves 38*b* becomes gradually larger so that an amount of the oil flowing into space C is slowly increased. That is, even at the time of start of actuation of valve body 38, an increment of the amount of the oil flowing into space C becomes gradually larger to thereby cause slow increase in quantity of the oil that is supplied to hysteresis brake 17. Accordingly, it is possible to suppress occurrence of unnecessary increase in braking force which is caused by drag of hysteresis ring 18 due to oil viscosity.

When the deformation of temperature detecting member 39 becomes still larger due to the oil temperature rise, valve body 38 is further projected from valve bore 37 so that a front tip end of valve body 38 comes into contact with a rear surface of plate member 2*b* of timing sprocket 2 to thereby limit the projecting movement of valve body 38. In this stage, the opening area of each of control passage grooves 38*b* becomes maximum to allow a large quantity of the oil to be supplied to the inside of rotational phase adjusting mechanism 3 through space C. As a result, it is possible to effectively cool and lubricate components such as hysteresis ring 18 and first electromagnetic coil 20.

Second Embodiment

Figure 5:
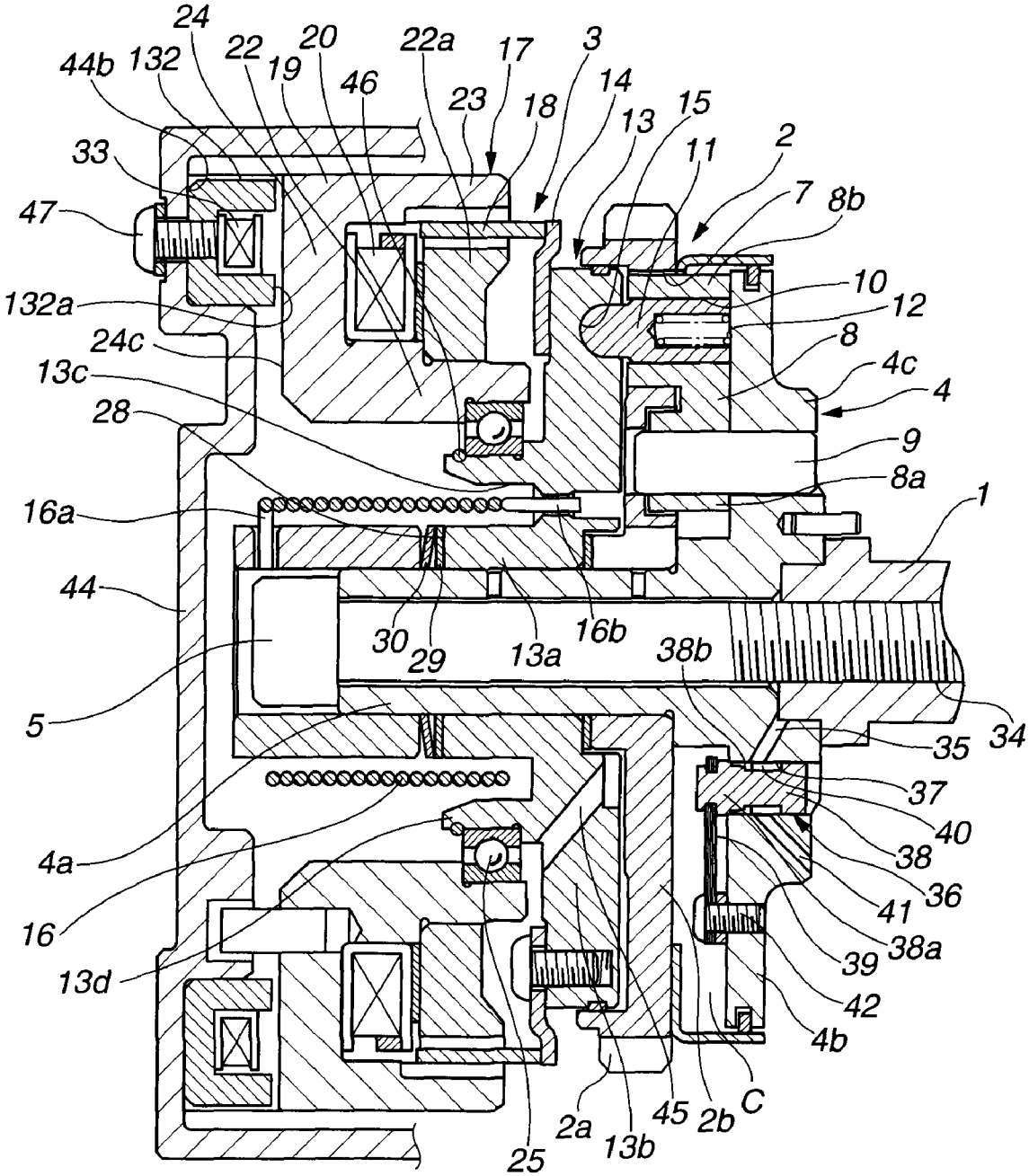
FIG. 5 is a vertical cross-section of a valve timing control apparatus according to a second embodiment of the present invention.

FIG. 5 shows a second embodiment of the present invention which is the same as the first embodiment except that the electromagnet constituting of the holding canceling mechanism is mounted to VTC cover 44.

Specifically, first coil yoke 19 and first electromagnetic coil 20 of hysteresis brake 17 are connected with spiral disk 13 through ball bearing 25, and slightly displaceable together with spiral disk 13 in the axial direction.

Second coil yoke 132 of the electromagnet constituting of the holding canceling mechanism is formed into a generally U-shape in section. Second coil yoke 132 is fitted into annular-shaped support groove 44*b* that is formed on an inside of an outer circumferential wall of VTC cover 44, and fixed to annular-shaped support groove 44*b* of VTC cover 44 by means of bolt 47. Second electromagnetic coil 33 is fixedly disposed on an inside of the U-shaped second coil yoke 132. Rear end surface 132*a* of second coil yoke 132 is opposed to front end surface 24*c* of annular yoke 24 of first coil yoke 19 with an air gap.

According to the second embodiment, when the engine is stopped, the relative rotational phase between camshaft 1 and timing sprocket 2 can be held in the phase position suitable for the engine restart by the detent torque that is produced in hysteresis ring 18, similar to the first embodiment. Therefore, the second embodiment can attain the same effect as that of the first embodiment.

Further, when energization of second electromagnetic coil 33 is interrupted, spiral disk 13 and hysteresis brake 17 are urged to move toward engaging pins 11 by the spring force of disc spring 29 so that spiral disk 13 is pressed onto engaging pins 11 to be in elastic contact therewith and thereby the relative rotational phase between camshaft 1 and timing sprocket 2 is held in a predetermined phase position. On the other hand, when second electromagnetic coil 33 is energized, first coil yoke 19 of hysteresis brake 17 is magnetically attracted to move forward together with spiral disk 13 against the spring force of disc spring 29, thereby causing cancellation of the holding state in which the relative rotational phase between camshaft 1 and timing sprocket 2 is held in the predetermined phase position. Accordingly, similar to the first embodiment, the control of holding the relative rotational phase between camshaft 1 and timing sprocket 2 in a desired phase position and canceling the holding can be performed in accordance with an engine operating condition. Therefore, the second embodiment can attain the same effect as that of the first embodiment.

Further, since second coil yoke 132 and second electromagnetic coil 33 are disposed within a dead space on the inside of VTC cover 44, the space can be effectively utilized and upsizing of the VTC in the radial direction can be avoided.

Third Embodiment

Figure 6:
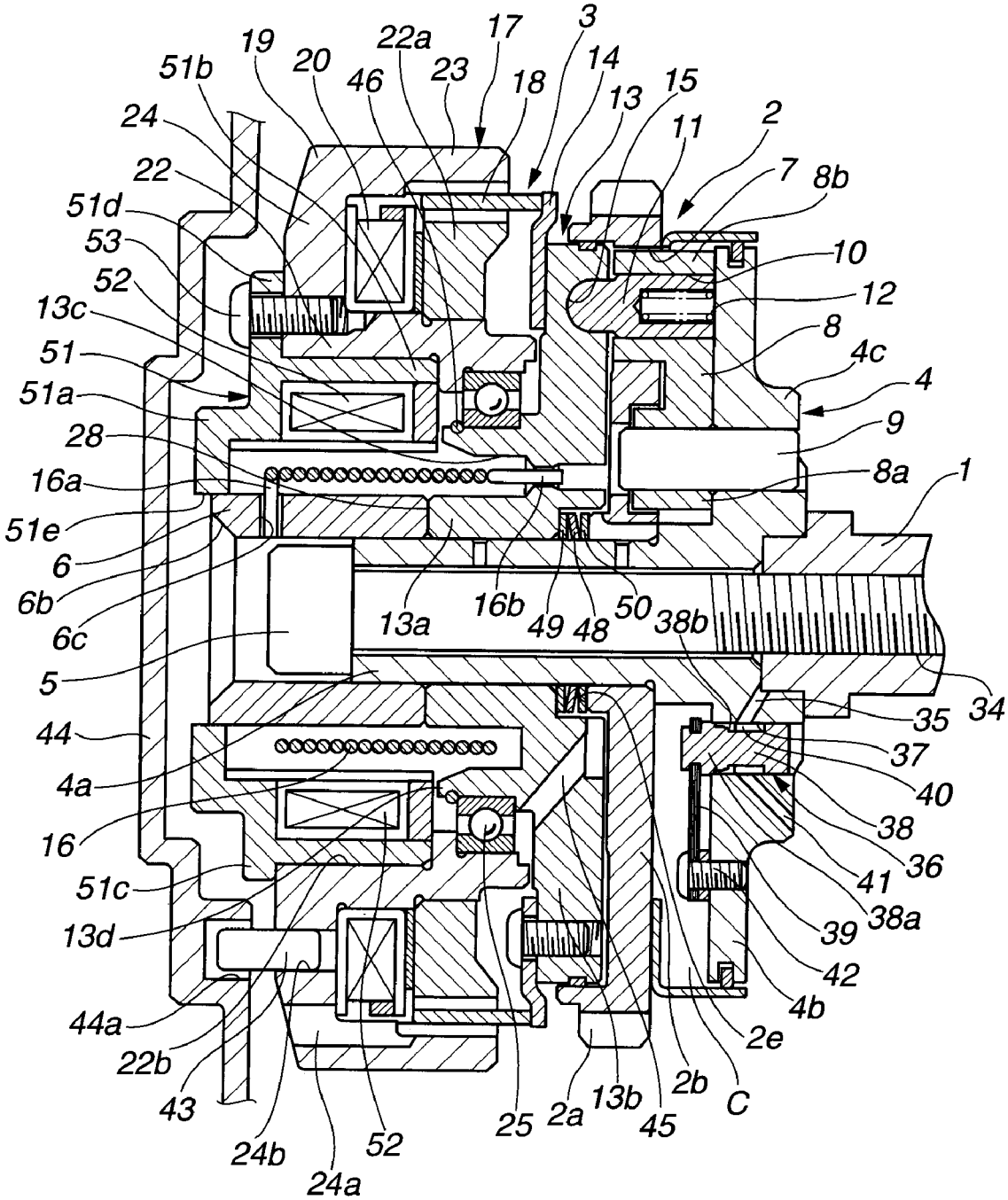
FIG. 6 is a vertical cross-section of a valve timing control apparatus according to a third embodiment of the present invention.

FIG. 6 shows a third embodiment of the present invention in which the relative rotational phase holding mechanism is constituted of an electromagnet and the holding canceling mechanism is constituted of a disc spring. In addition, in the third embodiment, the annular groove on the outer circumferential surface of the front end portion of sleeve 6 is omitted.

Figure 7A:
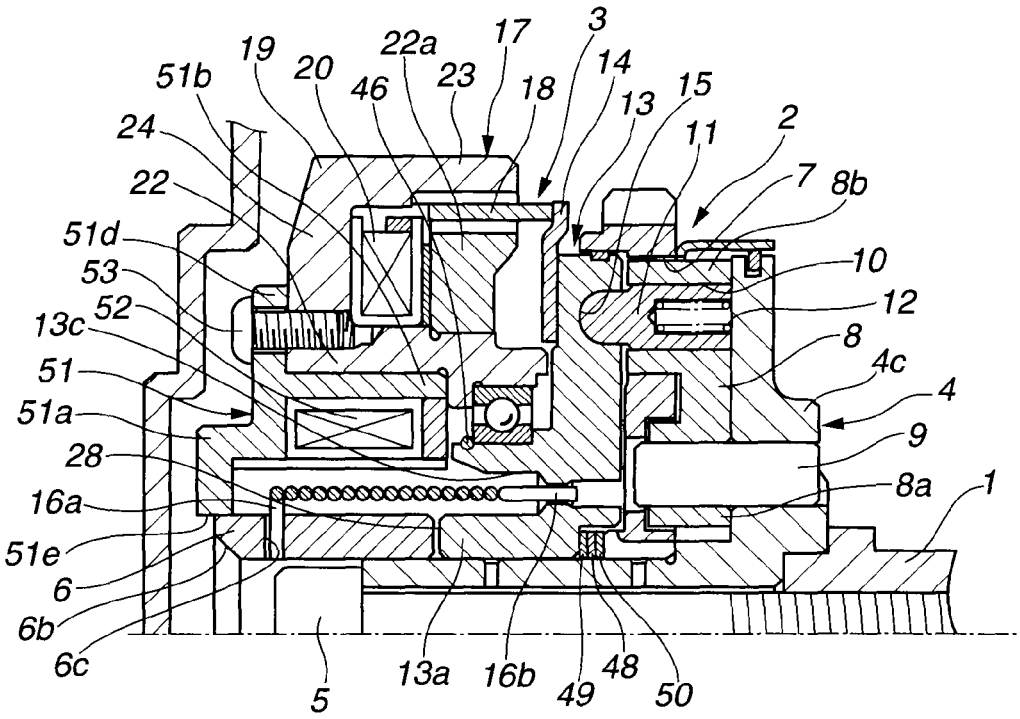
FIG. 7A is an explanatory diagram illustrating a holding state of the valve timing control apparatus of the third embodiment.
Figure 7B:
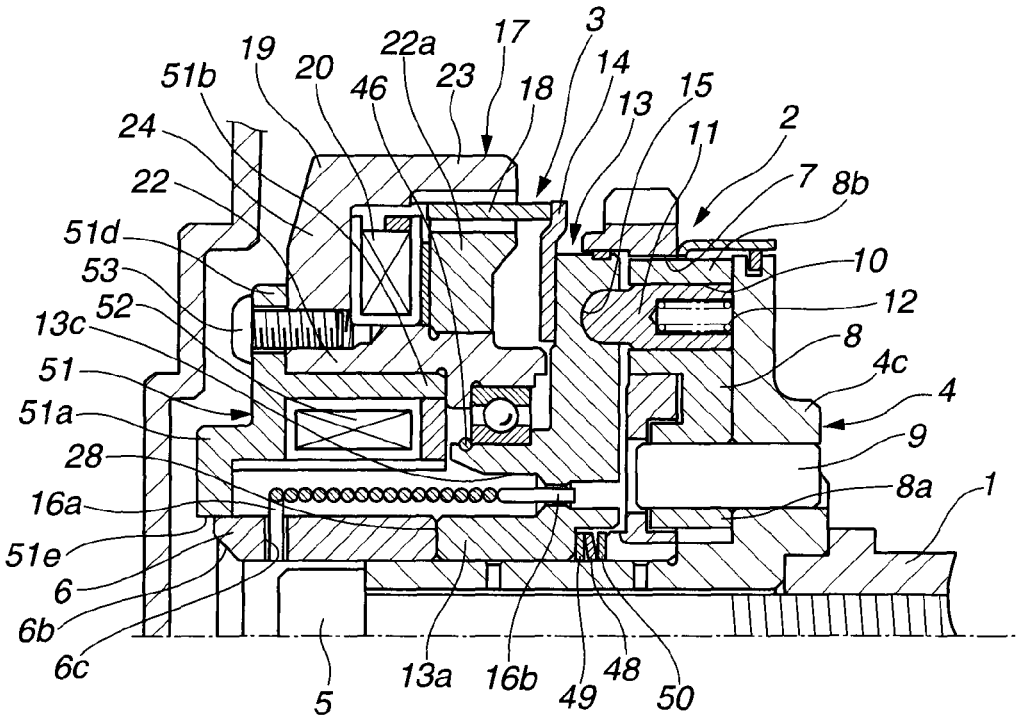
FIG. 7B is an explanatory diagram illustrating a release state of the valve timing control apparatus of the third embodiment.

Specifically, disc spring 48 constituting the holding canceling mechanism is disposed between front end surface 2*e* of a cylindrical inner periphery of plate member 2*b* of timing sprocket 2 and a bottom surface of an annular groove formed on a rear side of an inner circumferential surface of cylindrical inner circumferential portion 13*a* of spiral disk 13. Disc spring 48 biases spiral disk 13 in a releasing direction in which spiral disk 13 separates from engaging pins 11, namely, in the leftward direction as shown in FIG. 7B. Annular spring retainers 49, 50 are respectively disposed on a front side and a rear side of disc spring 48 in order to ensure good slidability of disc spring 48 when disc spring 48 is flexibly deformed.

The electromagnet constituting the relative rotational phase holding mechanism includes second coil yoke 51 and second electromagnetic coil 52 which have substantially the same construction as that of second coil yoke 32 and second electromagnetic coil 33 of the first embodiment. Second coil yoke 51 includes generally flange-shaped front yoke 51*a* and generally cylindrical rear yoke 51*b*. Front yoke 51*a* has projection 51*d* on outer circumferential periphery 51*c* which is fixed to the inner circumferential side of inner stator 22 of first coil yoke 19 by means of bolt 53. Inner circumferential surface 51*e* of an inner circumferential periphery of front yoke 51*a* is in contact with the outer circumferential surface of sleeve 6 only on a rear side thereof.

Second electromagnetic coil 52 is energized or de-energized through a harness, not shown, in response to ON signal or OFF signal output from the ECU. In response to the ON signal output from the ECU, second electromagnetic coil 52 is energized to magnetically attract and move hysteresis brake 17 and spiral disk 13 relative to sleeve 6 with the contact between inner circumferential surface 51*e* of front yoke 51*a* and the outer circumferential surface of sleeve 6 in a holding direction, that is, in the rightward direction in FIG. 6 and FIG. 7A, against the spring force of disc spring 48. Thus, by energizing second electromagnetic coil 52, spiral disk 13 is contacted with engaging pins 11 and held in the rotational position.

Figure 8:
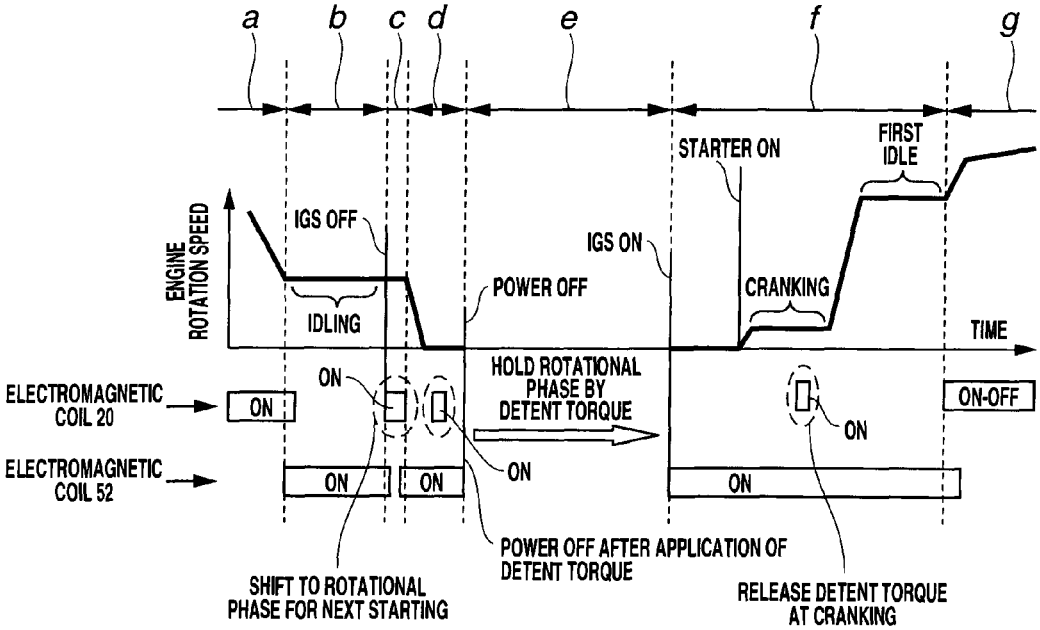
FIG. 8 is a time chart showing a control that is performed during a time period from engine stop to engine restart by the valve timing control apparatus of the third embodiment.

Similar to the first embodiment, when the engine is stopped, the relative rotational phase holding force is obtained utilizing the detent torque that is produced in hysteresis ring 18 by energizing and de-energizing first electromagnetic coil 20. However, the third embodiment differs from the first embodiment in the ON-OFF control of second electromagnetic coil 52 as explained below by referring to FIG. 8.

Specifically, in region "a", the engine is driven in the vehicle running state, and the control of the relative rotational phase between camshaft 1 and timing sprocket 2 is performed by hysteresis brake 17.

Next, in region "b", the vehicle is stopped and the engine is in the idling state. In this condition, the control of the relative rotational phase between camshaft 1 and timing sprocket 2 is not necessary. Therefore, energization of first electromagnetic coil 20 is interrupted and energization of second electromagnetic coil 52 is conducted to thereby perform the rotational phase holding operation.

Next, in region "c", the ignition switch (IGS) is turned off by a vehicle driver in order to stop the engine, but the engine rotation is not promptly stopped and the idling operation is continued. In this condition, energization of second electromagnetic coil 52 is interrupted and spiral disk 13 is temporarily released from the holding state (i.e., the contact state relative to engaging pins 11) by the spring force of disc spring 48. At the same time, first electromagnetic coil 20 is energized to thereby actuate hysteresis brake 17 to rotate spiral disk 13 so that the relative rotational phase between camshaft 1 and timing sprocket 2 is controlled to the desired phase position suitable for the engine restart, namely, the desired phase position in which the engine is enabled to restart. After the relative rotational phase between camshaft 1 and timing sprocket is controlled to the desired phase position suitable for the engine restart, second electromagnetic coil 52 is energized to apply the holding force to spiral disk 13 and hold spiral disk 13 in the rotational position against the spring force of disc spring 48.

Subsequently, in region "d", the engine rotation is stopped under the condition that the relative rotational phase between camshaft 1 and timing sprocket 2 is held in the phase position suitable for the engine restart by energization of second electromagnetic coil 52, and after the engine rotation is completely stopped, a constant voltage from a battery power source is temporarily applied to first electromagnetic coil 20 for a predetermined short time period to thereby excite first electromagnetic coil 20. That is, detent torque is produced in hysteresis ring 18 by energizing first electromagnetic coil 20 for the predetermined short time period. After that, when the battery power source is turned off, hysteresis ring 18 is magnetized under a fixed magnetic field to thereby maintain the relative rotational phase holding force that is produced by the detent torque.

Next, in region "e", the engine is in the completely stopped state. In this condition, energization of second electromagnetic coil 52 is interrupted and the detent torque produced in hysteresis ring 18 successively acts to hold the relative rotational phase between camshaft 1 and timing sprocket 2 in the phase position suitable for the engine restart, that is, hold engaging pins 11 and radially inwardly bent distal end portion 15*a* of spiral-grooved portion 15 of spiral disk 13 in the mutually engaged state.

Next, in region "f", at the time when the IGS is turned on in order to perform the engine restart, second electromagnetic coil 52 of the relative rotational phase holding mechanism is energized to perform the relative rotational phase holding operation against the spring force of disc spring 48 so that the relative rotational phase between camshaft 1 and timing sprocket 2 is maintained in the phase position suitable for the engine restart. The relative rotational phase holding operation by energization of second electromagnetic coil 52 may be performed at any time during a time period from at least turn-on of the IGS until turn-on of a starter motor. Subsequently, the starter motor is turned on and cranking is started. During the cranking, first electromagnetic coil 20 is energized to release the detent torque, and immediately after that, energization of first electromagnetic coil 20 is interrupted. The release of the detent torque can be performed at any time during a time period from immediately after the cranking is started until the control of the relative rotational phase between camshaft 1 and timing sprocket 2 is started in accordance with the engine operating condition. That is, hysteresis ring 18 has the property of releasing the detent torque and the rotational phase holding force when energization of first electromagnetic coil 20 is interrupted under a variable magnetic field. In the case of continuing the first idling after the engine is restarted, the relative rotational phase holding operation by energization of second electromagnetic coil 52 may be continued.

Next, in region "g", the control of the relative rotational phase between camshaft 1 and timing sprocket 2 is started in accordance with the engine operating condition. Immediately after the start of the control of the relative rotational phase, energization of second electromagnetic coil 52 is interrupted and the rotational phase holding operation is cancelled by the spring force of disc spring 48.

As explained above, in the third embodiment, when the engine is stopped, the relative rotational phase between camshaft 1 and timing sprocket 2 can be held in the phase position suitable for the engine restart by the detent torque that is produced in hysteresis ring 18. Accordingly, the restart of the engine can be better performed.

Further, the constant voltage that is applied to first electromagnetic coil 20 of electromagnetic brake 17 after the rotation of timing sprocket 2 is stopped may be an available maximum voltage.

Further, the torque that is produced by applying a voltage to second electromagnetic coil 52 of the relative rotational phase holding mechanism may be larger than the detent torque that is produced in electromagnetic brake 17.

Further, when the engine is stopped under a condition that the IGS is not turned off, first electromagnetic coil 20 of electromagnetic brake 17 and second electromagnetic coil 52 of the relative rotational phase holding mechanism may be prevented from being energized.

Further, when the engine is stopped under a condition that the IGS is not turned off, first electromagnetic coil 20 of electromagnetic brake 17 is energized during a time period of cranking upon restart of the engine to thereby perform control of the relative rotational phase between camshaft 1 and timing sprocket 2.

The present invention is not limited to the above embodiments. For instance, the disc spring used in the above embodiments can be replaced by a wave spring, a coil spring and a biasing member made of an elastic synthetic resin material. Further, the bimetal used as the temperature detecting member can be replaced by a member made of a shape memory alloy, or a wax pellet.

Further, in the above embodiments, distal end portion 15*a* of spiral-grooved portion 15 is radially inwardly bent, and when the engine is stopped, engaging pins 11 are moved to distal end portion 15*a* by alternate torque to thereby slightly advance the relatively rotational phase between camshaft 1 and timing sprocket 2. However, spiral-grooved portion 15 can be configured to have substantially a uniform spiral angle as a whole.

Furthermore, hysteresis brake 17 used as the electromagnetic mechanism can be replaced by an electric motor.

This application is based on a prior Japanese Patent Application No. 2008-70514 filed on Mar. 19, 2008. The entire contents of the Japanese Patent Application No. 2008-70514 are hereby incorporated by reference.

Although the invention has been described above by reference to certain embodiments of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member, to the camshaft; and an electromagnetic mechanism that acts to vary a relative rotational phase between the drive rotary member and the driven rotary member, wherein after an ignition switch is turned off and the engine is stopped, the electromagnetic mechanism acts to produce a detent torque and hold the relative rotational phase between the drive rotary member and the driven rotary member in a predetermined phase position by the detent torque.

2. The valve timing control apparatus as claimed in claim 1, wherein the electromagnetic mechanism acts to cancel the detent torque after the engine is started.

3. The valve timing control apparatus as claimed in claim 1, wherein when the ignition switch is turned off, the electromagnetic mechanism acts to control the relative rotational phase between the drive rotary member and the driven rotary member to a phase position suitable for restart of the engine, and after controlling, hold the relative rotational phase between the drive rotary member and the driven rotary member in the phase position suitable for restart of the engine by the detent torque.

4. A valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member to the camshaft;

an intermediate rotary member that rotates relative to the drive rotary member to vary a relative rotational phase between the drive rotary member and the driven rotary member; and a hysteresis brake including an electromagnetic coil, a stator core and a hysteresis member rotatable in synchronization with the intermediate rotary member;

wherein after an ignition switch is turned off and rotation of the crankshaft is stopped, a battery voltage is applied to the electromagnetic coil until a magnetic flux is generated in the electromagnetic coil.

5. The valve timing control apparatus as claimed in claim 4, wherein application of the battery voltage is stopped when the rotation of the crankshaft is stopped and immediately after the magnetic flux is generated in the electromagnetic coil.

6. The valve timing control apparatus as claimed in claim 4, wherein a constant voltage is applied to the electromagnetic coil for a predetermined time period at any time during a time period from the time when the rotation of the crankshaft is restarted after the stop until the control of the relative rotational phase between the drive rotary member and the driven rotary member is started, and wherein after the engine is started, the voltage applied to the electromagnetic coil is controlled to perform control of the relative rotational phase between the drive rotary member and the driven rotary member in accordance with an operating condition of the engine.

7. A valve timing control apparatus for an internal combustion engine, the internal combustion engine including a crankshaft and a camshaft, the valve timing control apparatus comprising:

a drive rotary member that is rotated by the crankshaft;

a driven rotary member that transmits rotational force input from the drive rotary member, to the camshaft;

an intermediate rotary member disposed in a route of transmitting the rotational force from the drive rotary member to the driven rotary member, the intermediate rotary member being moveable relative to the drive rotary member to vary a relative rotational phase between the drive rotary member and the driven rotary member;

a relative rotational phase holding mechanism that, when electrically energized, holds the relative rotational phase between the drive rotary member and the driven rotary member in an arbitrary phase position; and an electromagnetic brake including an electromagnetic coil, a stator core and a semi-hard magnetic member moveable together with the intermediate rotary member when the intermediate rotary member moves, the electromagnetic brake allowing a magnetic flux to pass through the semi-hard magnetic member upon applying a voltage to the electromagnetic coil, wherein in the process of turning off an ignition switch and stopping rotation of the drive rotary member, after the ignition switch is turned off, the relative rotational phase holding mechanism is energized to hold the relative rotational phase between the drive rotary member and the driven rotary member in the arbitrary phase position, and after the rotation of the drive rotary member is stopped, a predetermined voltage is applied to the electromagnetic coil of the electromagnetic brake for a predetermined time period, and after application of the predetermined voltage to the electromagnetic coil of the electromagnetic brake for the predetermined time period, energization of the relative rotational phase holding mechanism is interrupted.

8. The valve timing control apparatus as claimed in claim 7, wherein after the ignition switch is turned off, the electromagnetic brake is actuated and generates a braking force to control the relative rotational phase between the drive rotary member and the driven rotary member to a phase position in which the engine is enabled to start, and after the relative rotational phase between the drive rotary member and the driven rotary member is controlled by the braking force generated by the electromagnetic brake to the phase position in which the engine is enabled to start, the relative rotational phase holding mechanism is energized to hold the relative rotational phase between the drive rotary member and the driven rotary member in the phase position in which the engine is enabled to start.

9. The valve timing control apparatus as claimed in claim 8, wherein when the ignition switch is turned on, the relative rotational phase holding mechanism is energized to keep a holding state in which the relative rotational phase between the drive rotary member and the driven rotary member is held in the phase position in which the engine is enabled to start, and while the holding state is kept by the relative rotational phase holding mechanism, cranking is started.

10. The valve timing control apparatus as claimed in claim 9, wherein at arbitrary time during a time period from the time when the cranking is started until immediately before first control of the relative rotational phase between the drive rotary member and the driven rotary member in accordance with an operating condition of the engine is started, the predetermined voltage is applied to the electromagnetic coil of the electromagnetic brake for the predetermined time period.

11. The valve timing control apparatus as claimed in claim 10, wherein after the engine is restarted, energization of the relative rotational phase holding mechanism is interrupted.

12. The valve timing control apparatus as claimed in claim 11, wherein when an idling state is maintained after the engine is restarted, energization of the relative rotational phase holding mechanism is continued, and when shifting from the idling state to the first control of the relative rotational phase between the drive rotary member and the driven rotary member is performed, energization of the relative rotational phase holding mechanism is interrupted.

13. The valve timing control apparatus as claimed in claim 7, wherein the predetermined voltage that is applied to the electromagnetic coil of the electromagnetic brake after the rotation of the drive rotary member is stopped is an available maximum voltage.

14. The valve timing control apparatus as claimed in claim 7, wherein torque that is produced by applying a voltage to the relative rotational phase holding mechanism is larger than detent torque that is produced in the electromagnetic brake.

15. The valve timing control apparatus as claimed in claim 7, wherein the semi-hard magnetic member of the electromagnetic brake has a ring shape that is rotatable together with the intermediate rotary member, wherein the electromagnetic brake comprises a stator constituted of the electromagnetic coil that is wound into an annular shape and the stator core that has a generally annular shape so as to cover the electromagnetic coil, and wherein the stator core has an annular groove on a side of one axial end thereof in which the semi-hard magnetic member is disposed so as to be rotatable relative to the stator core, and has a plurality of pole teeth arranged on inner and outer circumferential surfaces of the stator core which are opposed to each other in a radial direction of the stator core and cooperate to define the annular groove, in an offset relation in a circumferential direction of the stator core.

16. The valve timing control apparatus as claimed in claim 15, wherein the relative rotational phase holding mechanism is disposed on an inner circumferential side of the stator of the electromagnetic brake.

17. The valve timing control apparatus as claimed in claim 7, further comprising a moveable actuating member, wherein the intermediate rotary member comprises a spiral guide that is gradually reduced in spiral radius along a circumferential direction of the intermediate rotary member and engaged with the moveable actuating member, and when the intermediate rotary member is rotated relative to the drive rotary member, the moveable actuating member is moved in a radial direction of the drive member to thereby vary the relative rotational phase between the drive rotary member and the driven rotary member, and wherein the relative rotational phase holding mechanism urges the intermediate rotary member toward the moveable actuating member to hold the relative rotational phase between the drive rotary member and the driven rotary member by an electromagnetic force that is generated by energization.

18. The valve timing control apparatus as claimed in claim 7, wherein when the engine is stopped under a condition that the ignition switch is not turned off, the electromagnetic coil of the electromagnetic brake and the relative rotational phase holding mechanism are prevented from being energized.

19. The valve timing control apparatus as claimed in claim 7, wherein when the engine is stopped under a condition that the ignition switch is not turned off, the electromagnetic coil of the electromagnetic brake is energized during a time period of cranking upon restart of the engine to thereby perform control of the relative rotational phase between the drive rotary member and the driven rotary member.

20. The valve timing control apparatus as claimed in claim 7, wherein when the electromagnetic coil of the electromagnetic brake and the relative rotational phase holding mechanism are not energized, the relative rotational phase between the drive rotary member and the driven rotary member is controlled to a phase position in which the engine is enabled to start.

21. The valve timing control apparatus as claimed in claim 20, wherein when the intermediate rotary member is biased in a direction of rotation of the drive rotary member so as to control the relative rotational phase between the drive rotary member and the driven rotary member to the phase position in which the engine is enabled to start.

* * * * *